US009199138B2

(12) United States Patent
Willett et al.

(10) Patent No.: US 9,199,138 B2
(45) Date of Patent: Dec. 1, 2015

(54) GOLF CLUBS AND CLUB-HEADS COMPRISING A FACE PLATE HAVING A CENTRAL RECESS AND FLANKING RECESSES

(75) Inventors: Kraig Alan Willett, Fallbrook, CA (US); Todd P. Beach, San Diego, CA (US); Gery Mel Zimmerman, Fallbrook, CA (US); Joseph Henry Hoffman, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 881 days.

(21) Appl. No.: 12/456,900

(22) Filed: Jun. 23, 2009

(65) Prior Publication Data

US 2009/0264218 A1 Oct. 22, 2009

Related U.S. Application Data

(63) Continuation of application No. 11/567,669, filed on Dec. 6, 2006, now Pat. No. 7,575,524.

(51) Int. Cl.
*A63B 53/04* (2015.01)

(52) U.S. Cl.
CPC ..... *A63B 53/0466* (2013.01); *A63B 53/047* (2013.01); *A63B 2053/0416* (2013.01); *A63B 2053/0454* (2013.01); *A63B 2053/0458* (2013.01)

(58) Field of Classification Search
USPC ..... 473/324–350
See application file for complete search history.

(56) References Cited

U.S. PATENT DOCUMENTS

| | | | | | |
|---|---|---|---|---|---|
| 1,671,956 | A | * | 5/1928 | Sime | 473/329 |
| 2,087,685 | A | * | 7/1937 | Hackney | 473/349 |
| 3,233,905 | A | * | 2/1966 | Flom | 473/342 |

(Continued)

FOREIGN PATENT DOCUMENTS

| | | | | | |
|---|---|---|---|---|---|
| GB | 2321201 | A | * | 7/1998 | A63B 53/04 |
| JP | 05212139 | A | * | 8/1993 | A63B 53/04 |

(Continued)

OTHER PUBLICATIONS

Photos of Taylormade Burner 2007 Driver, Callaway FT-5 Driver, Callaway FTi Driver, Cobra L4V Cross-section Driver, Cobra Speed LD Driver, Nike SQ Driver, PING Rapture Driver, Taylormade R7 425 Driver, Taylormade R7 460 Driver, Taylormade R7 Superquad Driver, Titleist 905S Driver, and Titleist907 D2 Driver, 6 pp.

*Primary Examiner* — Alvin Hunter
(74) *Attorney, Agent, or Firm* — Klarquist Sparkman, LLP

(57) ABSTRACT

Golf club-heads are disclosed that have a body and a face plate. Exemplary club-heads are hollow metal-wood club-heads. The face plate is attached to the front of the body and has obverse and reverse surfaces, and a peripheral zone, toe zone, heel zone, upper zone, lower zone, and central zone. The reverse surface defines in the central zone a recess surrounded by a substantially annular ridge. The reverse surface also defines in the toe zone and heel zone respective horizontal flanking recesses. The reverse surface also defines in the upper zone and lower zone respective vertical flanking recesses. The maximal thickness of the annular ridge is greater than the respective thicknesses of the central recess and flanking recesses, and the respective thicknesses of the flanking recesses are no greater than the thickness of the central recess.

20 Claims, 9 Drawing Sheets
(4 of 9 Drawing Sheet(s) Filed in Color)

(56) References Cited

U.S. PATENT DOCUMENTS

| | | | | | |
|---|---|---|---|---|---|
| 4,432,549 | A | | 2/1984 | Zebelean | |
| 4,826,172 | A | * | 5/1989 | Antonious | 473/350 |
| 4,928,965 | A | | 5/1990 | Yamaguchi et al. | |
| 5,028,049 | A | | 7/1991 | McKeighen | |
| 5,076,585 | A | | 12/1991 | Bouquet | |
| 5,362,047 | A | | 11/1994 | Shaw et al. | |
| 5,451,056 | A | | 9/1995 | Manning | |
| 5,465,970 | A | | 11/1995 | Adams et al. | |
| 5,595,552 | A | * | 1/1997 | Wright et al. | 473/332 |
| 5,626,530 | A | * | 5/1997 | Schmidt et al. | 473/324 |
| 5,643,108 | A | * | 7/1997 | Cheng | 473/329 |
| 5,707,302 | A | * | 1/1998 | Leon et al. | 473/324 |
| 5,766,094 | A | * | 6/1998 | Mahaffey et al. | 473/342 |
| 5,776,011 | A | * | 7/1998 | Su et al. | 473/345 |
| 5,830,084 | A | * | 11/1998 | Kosmatka | 473/349 |
| 5,851,160 | A | | 12/1998 | Rugge et al. | |
| 5,873,795 | A | * | 2/1999 | Wozny et al. | 473/350 |
| 5,921,869 | A | * | 7/1999 | Blough et al. | 473/291 |
| 5,971,868 | A | * | 10/1999 | Kosmatka | 473/349 |
| 5,993,331 | A | * | 11/1999 | Shieh | 473/342 |
| 6,010,411 | A | * | 1/2000 | Reyes | 473/345 |
| 6,074,309 | A | * | 6/2000 | Mahaffey | 473/342 |
| 6,224,494 | B1 | | 5/2001 | Patsky | |
| 6,248,025 | B1 | * | 6/2001 | Murphy et al. | 473/324 |
| 6,290,609 | B1 | * | 9/2001 | Takeda | 473/335 |
| 6,319,150 | B1 | | 11/2001 | Werner et al. | |
| 6,348,015 | B1 | | 2/2002 | Kosmatka | |
| 6,379,262 | B1 | * | 4/2002 | Boone | 473/324 |
| 6,413,169 | B1 | * | 7/2002 | Kosmatka | 473/329 |
| 6,428,425 | B1 | | 8/2002 | Naruo et al. | |
| 6,488,594 | B1 | * | 12/2002 | Card et al. | 473/340 |
| 6,605,007 | B1 | * | 8/2003 | Bissonnette et al. | 473/329 |
| 6,612,938 | B2 | * | 9/2003 | Murphy et al. | 473/324 |
| 6,652,391 | B1 | * | 11/2003 | Kubica et al. | 473/345 |
| 6,773,360 | B2 | | 8/2004 | Willett et al. | |
| 6,780,124 | B2 | * | 8/2004 | Lu | 473/342 |
| 6,800,038 | B2 | * | 10/2004 | Willett et al. | 473/329 |
| 6,800,039 | B1 | * | 10/2004 | Tseng | 473/329 |
| 6,821,214 | B2 | * | 11/2004 | Rice | 473/345 |
| 6,824,475 | B2 | * | 11/2004 | Burnett et al. | 473/329 |
| 6,899,638 | B2 | * | 5/2005 | Iwata et al. | 473/329 |
| 6,904,663 | B2 | * | 6/2005 | Willett et al. | 29/557 |
| 6,926,618 | B2 | * | 8/2005 | Sanchez et al. | 473/329 |
| 6,991,558 | B2 | | 1/2006 | Beach et al. | |
| 6,997,820 | B2 | * | 2/2006 | Willett et al. | 473/329 |
| 7,018,303 | B2 | * | 3/2006 | Yamamoto | 473/329 |
| 7,025,692 | B2 | | 4/2006 | Erickson et al. | |
| 7,029,403 | B2 | | 4/2006 | Rice et al. | |
| 7,066,832 | B2 | * | 6/2006 | Willett et al. | 473/329 |
| 7,097,573 | B2 | * | 8/2006 | Erickson et al. | 473/345 |
| 7,101,289 | B2 | * | 9/2006 | Gibbs et al. | 473/329 |
| 7,131,912 | B1 | * | 11/2006 | Knuth | 473/342 |
| 7,137,907 | B2 | * | 11/2006 | Gibbs et al. | 473/329 |
| 7,140,974 | B2 | | 11/2006 | Chao et al. | |
| 7,147,572 | B2 | | 12/2006 | Kohno | |
| 7,166,040 | B2 | | 1/2007 | Hoffman et al. | |
| 7,166,207 | B2 | | 1/2007 | Chao et al. | |
| 7,186,190 | B1 | | 3/2007 | Beach et al. | |
| 7,192,364 | B2 | * | 3/2007 | Long | 473/329 |
| 7,258,626 | B2 | * | 8/2007 | Gibbs et al. | 473/329 |
| 7,261,643 | B2 | * | 8/2007 | Rice et al. | 473/329 |
| 7,267,620 | B2 | | 9/2007 | Chao et al. | |
| 7,331,877 | B2 | | 2/2008 | Yamaguchi et al. | |
| 7,361,099 | B2 | * | 4/2008 | Rice et al. | 473/329 |
| 7,384,348 | B2 | * | 6/2008 | Lin et al. | 473/332 |
| 7,407,447 | B2 | | 8/2008 | Beach et al. | |
| 7,419,441 | B2 | | 9/2008 | Hoffman et al. | |
| 7,442,132 | B2 | * | 10/2008 | Nishio | 473/342 |
| 7,527,565 | B1 | | 5/2009 | Ehlers et al. | |
| 7,549,934 | B2 | | 6/2009 | Rice | |
| 7,575,524 | B2 | * | 8/2009 | Willett et al. | 473/342 |
| 7,575,525 | B2 | * | 8/2009 | Matsunaga et al. | 473/342 |
| 7,628,707 | B2 | | 12/2009 | Beach et al. | |
| 7,682,262 | B2 | * | 3/2010 | Soracco et al. | 473/329 |
| 7,785,213 | B2 | * | 8/2010 | Matsunaga et al. | 473/342 |
| 7,798,916 | B2 | * | 9/2010 | Matsunaga et al. | 473/329 |
| 7,883,431 | B2 | * | 2/2011 | Matsunaga et al. | 473/329 |
| 2002/0065146 | A1 | | 5/2002 | Kusumoto | |
| 2003/0036442 | A1 | | 2/2003 | Chao et al. | |
| 2005/0059508 | A1 | | 3/2005 | Burnett et al. | |
| 2006/0252576 | A1 | * | 11/2006 | Lo | 473/342 |
| 2008/0132356 | A1 | | 6/2008 | Chao et al. | |
| 2008/0139334 | A1 | * | 6/2008 | Willett et al. | 473/329 |
| 2008/0146374 | A1 | | 6/2008 | Beach et al. | |
| 2008/0149267 | A1 | | 6/2008 | Chao | |
| 2008/0254911 | A1 | | 10/2008 | Beach et al. | |
| 2008/0300068 | A1 | | 12/2008 | Chao | |
| 2009/0005191 | A1 | | 1/2009 | Lin | |
| 2009/0163289 | A1 | | 6/2009 | Chao | |
| 2009/0163291 | A1 | | 6/2009 | Chao | |
| 2009/0163292 | A1 | | 6/2009 | Chao | |
| 2009/0227389 | A1 | | 9/2009 | Meyer et al. | |

FOREIGN PATENT DOCUMENTS

| | | | | | |
|---|---|---|---|---|---|
| JP | 06182005 | A | * | 7/1994 | A63B 53/04 |
| JP | 06218083 | A | * | 8/1994 | A63B 53/04 |
| JP | 07163687 | A | * | 6/1995 | A63B 53/04 |
| JP | 08155060 | A | * | 6/1996 | A63B 53/04 |
| JP | 08243194 | A | * | 9/1996 | A63B 53/04 |
| JP | 8280853 | | | 10/1996 | |
| JP | 08308967 | A | * | 11/1996 | A63B 53/04 |
| JP | 2651565 | | | 9/1997 | |
| JP | 09239074 | A | * | 9/1997 | A63B 53/04 |
| JP | 09253243 | A | * | 9/1997 | A63B 53/04 |
| JP | 09299519 | A | * | 11/1997 | A63B 53/04 |
| JP | 11042300 | A | * | 2/1999 | A63B 53/04 |
| JP | 11216204 | A | * | 8/1999 | A63B 53/04 |
| JP | 11235406 | A | * | 8/1999 | A63B 53/04 |
| JP | 2000126340 | A | * | 5/2000 | A63B 53/04 |
| JP | 2001252379 | A | * | 9/2001 | A63B 53/04 |
| JP | 2002-017912 | | | 1/2002 | |
| JP | 2002000777 | A | * | 1/2002 | A63B 53/04 |
| JP | 2002-136626 | | | 5/2002 | |
| JP | 2002143350 | A | * | 5/2002 | A63B 53/04 |
| JP | 2002165904 | A | * | 6/2002 | A63B 53/04 |
| JP | 2003102879 | A | * | 4/2003 | A63B 53/04 |
| JP | 2003210622 | A | * | 7/2003 | A63B 53/04 |
| JP | 2003310807 | A | * | 11/2003 | A63B 53/04 |
| JP | 2004097550 | A | * | 4/2004 | A63B 53/04 |
| JP | 2004129943 | A | * | 4/2004 | A63B 53/02 |
| JP | 2004129944 | A | * | 4/2004 | A63B 53/04 |
| JP | 2004135990 | A | * | 5/2004 | A63B 53/02 |
| JP | 2004208728 | A | * | 7/2004 | A63B 53/04 |
| JP | 2004267630 | A | * | 9/2004 | A63B 53/04 |
| JP | 2004298478 | A | * | 10/2004 | A63B 53/04 |
| JP | 2006166975 | A | * | 6/2006 | |
| JP | 2006167279 | A | * | 6/2006 | |
| JP | 2006263162 | A | * | 10/2006 | |
| JP | 2007082752 | A | * | 4/2007 | |
| JP | 2007313330 | A | * | 12/2007 | |

* cited by examiner

GOLF CLUBS AND CLUB-HEADS COMPRISING A FACE PLATE HAVING A CENTRAL RECESS AND FLANKING RECESSES

CROSS-REFERENCE TO RELATED APPLICATION

This application is a continuation of, and claims priority to and the benefit of, U.S. patent application Ser. No. 11/567,669, filed on Dec. 6, 2006, now U.S. Pat. No. 7,575,524 which is incorporated herein by reference in its entirety.

FIELD

This disclosure pertains generally to golf clubs and club-heads. More particularly the disclosure pertains to, inter alia, wood-type club-heads and other types of club-heads that have a face insert.

BACKGROUND

With the ever-increasing popularity and competitiveness of golf, substantial effort and resources are currently being expended to improve golf clubs so that increasingly more golfers can have more fun and more success at playing golf. Much of this improvement activity has been in the realms of sophisticated materials and club-head engineering. For example, modern "wood-type" golf clubs (notably, "drivers" and "utility clubs"), with their sophisticated shafts and metal club-heads, bear little resemblance to the "wood" drivers, low-loft long-irons, and higher numbered fairway woods used years ago. These modern wood-type clubs are generally called "metal-woods."

An exemplary metal-wood golf club such as a fairway wood or driver typically includes a shaft having a lower end to which a hollow club-head is attached. The club-head usually is made, at least in part, of a light-weight but strong metal such as titanium alloy. The club-head comprises a body to which a strike plate (also called "face plate") is attached or integrally formed. The body includes a hosel that extends generally upward and is connected to the shaft of the club. The body also includes a heel region situated close to the hosel, a toe region situated opposite the heel region, a sole (lower) region, and a crown (upper) region. The body bears most of the impact load imparted to the strike plate when the club-head strikes a golf ball. The strike plate defines a front surface or strike face that actually contacts the golf ball.

In contrast to wood-type clubs used years ago, the club-heads of many modern metal-woods are hollow, which has been made possible by the use of light-weight, strong metals and other materials for fabricating the club-head. Use of titanium and other light-weight metal alloys has permitted the walls of the club-head to be made very thin, which has permitted the club-heads to be made substantially larger than their predecessors. These oversized club-heads tend to provide a larger "sweet spot" on the strike plate and higher club-head inertia, thereby making the club-heads more "forgiving" than smaller club-heads. This "forgiveness" means that a golfer using the club who strikes the ball off the center, or "sweet spot," of the club's strike plate still produces a ball trajectory that is substantially similar to the shot that otherwise would have been made if the golfer struck the ball on the sweet spot. Characteristics such as size of the sweet spot are determined by many variables including the shape profile, size, and thickness of the strike plate as well as the location of the center of gravity (CG) of the club-head.

There are practical limits to the maximum size of club-heads, based on factors such as the particular material of the club-head, the mass of the club-head, and the strength of the club-head. Since the maximal mass of the club-head is limited under USGA rules, as the club-head size is increased, the walls of the body and face plate generally are made correspondingly thinner. The distribution of mass around the club-head typically is quantified by parameters such as rotational moment of inertia (MOI) and CG location. Club-heads typically have multiple rotational MOIs, each associated with a respective Cartesian reference axis of the club-head. A rotational MOI is a measure of the club-head's resistance to angular acceleration (twisting or rotation) about the respective reference axis. The rotational MOIs are related to, inter alia, the distribution of mass in the club-head with respect to the respective reference axes. Specifically, a wood-type club-head has a first rotational MOI about an x-axis (a horizontal heel-toe axis extending through the CG generally parallel to the face), a second rotational MOI about a z-axis (a vertical axis also extending through the CG), and a third rotational MOI about a y-axis (a horizontal front-back axis orthogonal to the x- and z-axes and also extending through the CG). The third rotational MOI usually is less significant than the other two. Here, "horizontal" is relative to the ground whenever the club-head is at address position relative to the golf ball. Each of these rotational MOIs desirably is high to provide the club-head with more forgiveness.

To achieve high rotational MOIs, and thus more forgiveness, the mass of the club-head typically is distributed, as much as possible, around the periphery of the club-head and rearward of the face plate. As a result, the club-head's CG generally is located rearwardly from the face plate at a prescribed location, which also helps the club to produce a desired launch angle upon impact with a golf ball.

Another factor in club-head design is the face plate. Impact of the face plate with the golf ball causes deflection of the face plate. This deflection and the subsequent recoil are measured as the club-head's coefficient of restitution (COR). A thinner face plate generally deflects more at impact than a thicker face plate of the same material. Thus, a club-head having a thin face plate can impart more energy and thus a higher initial velocity (rebound velocity) to a struck golf ball than a club with a thicker, more rigid face plate. This rebound phenomenon is called the "trampoline effect" and is an important determinant of the flight distance of the struck ball. Since face-plate deflection is usually greater in the sweet spot of the face plate, a ball struck by the sweet spot generally will have a higher rebound velocity than a ball struck off-center. Because of the importance of the trampoline effect, the COR of clubs is limited under USGA rules.

To achieve these ends, it typically is desirable to incorporate thin walls, including the face plate, into the designed configuration of the club-head. Thin walls also allow additional leeway in distributing club-head mass to achieve a desired mass distribution and a desired high COR.

The mass and volume of metal wood-type drivers are governed by USGA rules. Certain types of metal wood-type club-heads are quite large and have a volume that is equal to or nearly equal to 460 $cm^3$, which is the maximum allowed by the USGA. These clubs typically have a large strike face that presents a tall face height to the ball. Consequently, with many golfers using these clubs, there is an increased probability that the ball will be struck by the strike plate at a location other than the sweet spot. These off-center shots deliver substantial stresses to the club-head to angularly pivot about the x-axis and/or z-axis. To make the club-head more resistant to such pivoting in response to these stresses, these large club-heads (indeed all club-heads) must have sufficient respective rotational MOIs about the CG of the club-head.

Regarding the total mass as the mass budget for the club-head, it is axiomatic that at least some of the mass be dedicated to achieving the required strength and structural support of the club-head. This is termed "structural" mass. Any mass remaining in the budget is called "discretionary" or "performance" mass, which can be distributed within the club-head to maximize performance. Much of the current research and development activity concerning golf clubs is directed to various ways of distributing the discretionary mass. For example, some club-heads include one or more weights placed relative to the heel-toe (x) axis and in-line with the percussion axis of the club-head. This manner of "perimeter weighting" can increase the rotational MOI of the club-head about the vertical (z) axis and increase the rotational MOI about the x-axis.

As club-head engineering converges on certain basic arrangements of discretionary mass in a club-head, particularly in metal-woods, achieving a maximal amount of any remaining discretionary mass is becoming increasingly important. It is also becoming more difficult to find sources of discretionary mass in the club-head that can be positioned advantageously. One general approach has focused on removing some mass from the strike plate while maintaining a uniform strike-plate thickness but without compromising the performance (e.g., stiffness) or durability of the strike plate. Unfortunately, if too much mass is removed from the strike plate under these conditions, the structural mass of the strike plate may be excessively compromised, which can result in the strike plate becoming too fragile and/or its COR becoming too high. Problems may also arise from stresses evenly distributed across the club-head upon impact with a golf ball, particularly at junctions of the face plate with other club-head components. In other words, many of these schemes are unsatisfactory, at least with certain club-heads.

In view of the above, various approaches have been investigated involving alteration of the face-plate configuration. For example, reference is made to U.S. Pat. Nos. 6,800,038; 6,824,475; 6,904,663; and 6,997,820, all incorporated herein by reference. Essentially, these references discuss various schemes for altering the thickness profile of the sweet spot. Specifically, on the rear (inner) surface of the strike plate, the "center" of the strike plate is relatively thin and is surrounded by an annular ridge, thereby giving the sweet spot a "volcano"-like thickness profile. The remainder of the strike plate, peripheral to the annular ridge, is of substantially uniform thickness or is made progressively thinner with increased radius from the center. Whereas these configurations showed some promise for some applications, they were not satisfactory in other applications.

SUMMARY

To address various needs that arise in golf club-head configurations, a first aspect is directed to club-heads for golf clubs. An embodiment of such a club-head comprises a body. In the manner of all club-heads, the body has a top, a sole, a toe, a heel, and a front. The body can be hollow, wherein the top, sole, toe, heel, and front have corresponding walls. An example is a body for a modern metal-wood. Alternatively, one or more of the top, sole, toe, heel, and front can have a "solid" or partially solid configuration, such as in any of various "irons."

The face plate is attached to the front of the body and has an obverse surface, a reverse surface, a peripheral zone, a toe zone, a heel zone, an upper zone, a lower zone, and a central zone. The reverse surface defines in the central zone a central recess having a thickness and a substantially annular ridge surrounding the central recess and having a maximal respective thickness. The reverse surface also defines in the toe zone and heel zone respective horizontal flanking recesses each having respective thicknesses. The reverse surface also defines in the upper zone and lower zone respective vertical flanking recesses each having respective thicknesses. The maximal thickness of the annular ridge is greater than the respective thicknesses of the central recess and flanking recesses, and the respective thicknesses of the flanking recesses are no greater than the thickness of the central recess. Desirably, the respective thicknesses of the flanking recesses are less than the thickness of the central recess.

The respective thicknesses of each of the flanking recesses can be substantially equal. The thickness of the peripheral zone can be substantially equal to the thickness of the central recess. The thickness of the face plate can progressively decrease from the maximal thickness of the annular ridge to each of the flanking recesses.

The face plate in most club-head configurations has a "sweet spot," wherein the central recess desirably is located substantially in the center of the sweet spot. The annular ridge can be situated substantially within the sweet spot.

As noted, the club-head can be configured as a hollow "metal-wood" club-head. In certain embodiments of this configuration the respective thicknesses of the flanking recesses are no greater than the respective wall thicknesses of the top, sole, heel, and toe. In other embodiments the thickness of the central recess is greater than the respective wall thicknesses of the top, sole, heel, and toe.

In many embodiments the body further comprises a sole-lip and a crown-lip. In such a configuration the sole-lip and crown-lip desirably are thicker than respective wall thicknesses of the toe, heel, sole, and top of the body. In addition or alternatively, each of the sole-lip and crown-lip comprises at least one rib. In other embodiments the body further comprises a sole-lip, a crown-lip, a toe-lip, and a heel-lip. At least one of these lips further can comprise at least one rib. If multiple ribs are present, they are not limited to a particular orientation such as vertical. Various factors, which can include the specific locations of the ribs, may indicate rib(s) having other orientations.

By way of example, the club-head can be configured as a metal-wood club-head or as an iron-type club-head.

According to another aspect, golf clubs are provided. An embodiment comprises a club-head and a shaft attached to the club-head, such as via a hosel. Various embodiments of such a club-head can have any of the configurations summarized above. Exemplary golf clubs are metal-woods and irons.

According to another aspect, face plates are provided for club-heads. Various embodiments of such a face plate can have any of the configurations summarized above. The face plate can be made of a material comprising a metal. For example, the face plate can be made of at least one material selected from the group consisting of steels, titanium alloys, and composites.

The foregoing and additional features and advantages of the invention will be more readily apparent from the following detailed description, which proceeds with reference to the accompanying drawings.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

FIGS. 2(A)-2(C) depict details of a face plate of a first representative embodiment of a wood-type club-head, wherein FIG. 2(A) is a plan view of the inner surface ("reverse surface") of the face plate, FIG. 2(B) is a section along the line denoted "B", and FIG. 2(C) is a section along the line denoted "C".

FIG. 4(A) is a perspective view (in color) from a coronal (horizontal) plane bisecting the club-head, FIG. 4(B) is a perspective view (in color) from a location on the coronal plane, and FIG. 4(C) is a perspective view (in color) from above the coronal plane.

DETAILED DESCRIPTION

This disclosure is set forth in the context of representative embodiments that are not intended to be limiting in any way.

In the following description, certain terms may be used such as "up," "down,", "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

Figure 1:
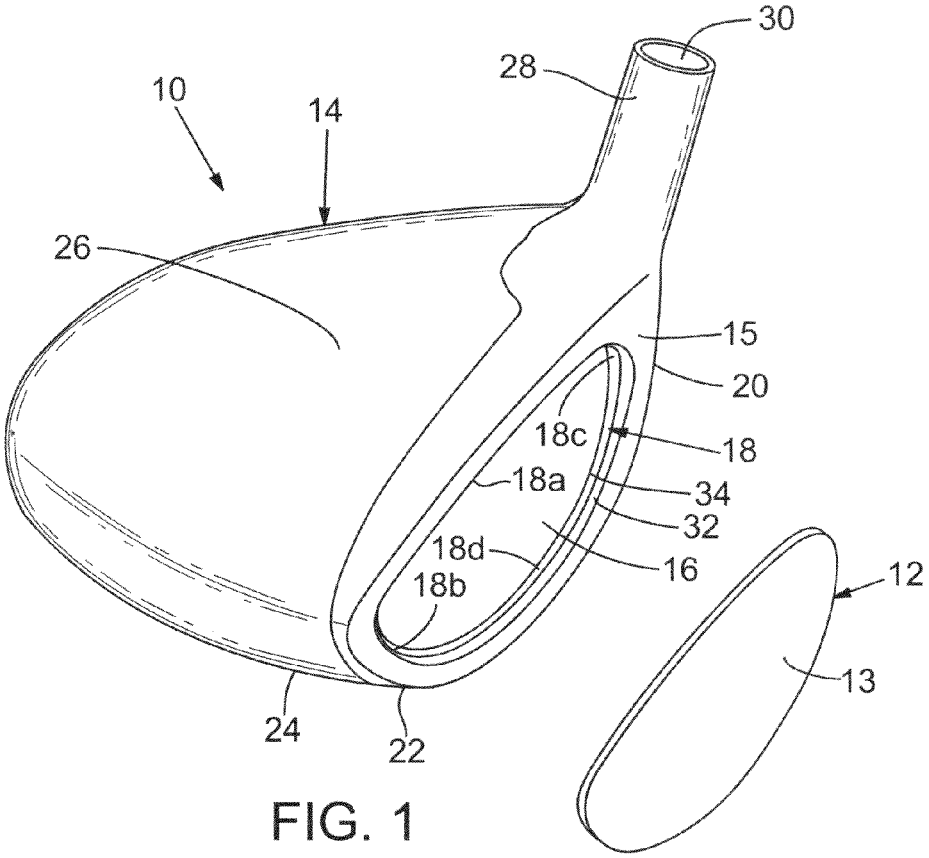
FIG. 1 is a perspective view showing certain features of an exemplary wood-type club-head.

The main features of an exemplary metal-wood club-head 10 are depicted in FIG. 1. The club-head 10 comprises a face plate 12 and a body 14. The face plate 12, also called a "strike plate," has convexity, and has an external ("obverse") surface 13. The body 14 includes a forward wall 15 defining a front opening 16. A face support 18 is disposed about the front opening 16. The body 14 also has a heel 20, a toe 22, a sole 24, a top or crown 26, and a hosel 28. The hosel 28 defines an opening 30 that receives a distal end of a shaft (not shown). The face support 18 receives the face plate 12, thereby enclosing the front opening 16. The face plate 12 contributes to the durability and performance characteristics of the club-head 10. The face support 18 includes respective portions 18*a*-18*d* situated proximally to the crown 26, the toe 22, the heel 20, and the sole 24. The face support 18 can be continuous or comprise multiple portions with gaps between them. In the front opening 16 each of the portions 18*a*-18*d* includes a peripheral wall 32 extending rearwardly from the forward wall 15 and a rear member 34 extending inwardly from the peripheral member 32.

As discussed in U.S. Patent Publication No. 2005/0239575, incorporated herein by reference, the face support 18 is a factor that generally contributes to the COR of the face plate 12, even about the periphery of the face plate, while providing durable support for the face plate. The body 14 typically is made of a high-stiffness, high-strength, low-mass metal such as titanium alloy. The face plate 12 can be made of the same material as the body 14 (allowing welding of the face plate to the body after inserting the face plate in the opening 16 to rest upon the face support 18) or of a different material. Different materials are difficult to impossible to bond together by welding. Hence, other bonding techniques usually are required in such instances. For example, if the face plate 12 is made of a composite material (as discussed in U.S. Patent Publication No. 2004/0235584, incorporated herein by reference) and the body 14 is made of a metal such as titanium alloy, then the face plate can be bonded to the body using a suitable adhesive such as an epoxy adhesive.

A representative embodiment of a club-head comprises a body that is similar in many ways to the body 14 shown in FIG. 1. The differences reside mainly in the face plate and adjacent structure, as discussed below.

Figure 2A:
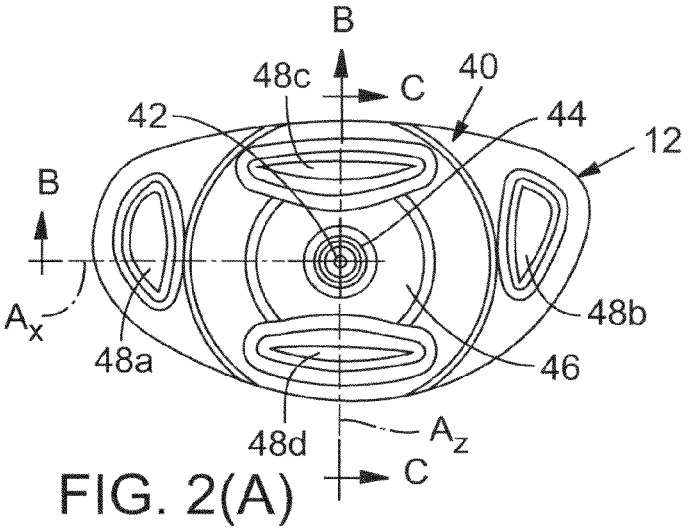
Figure 2C:
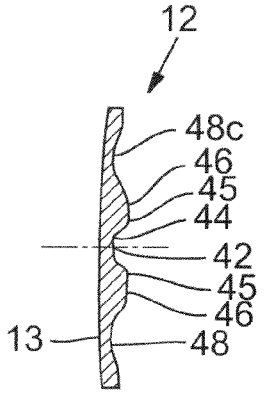
Figure 2B:
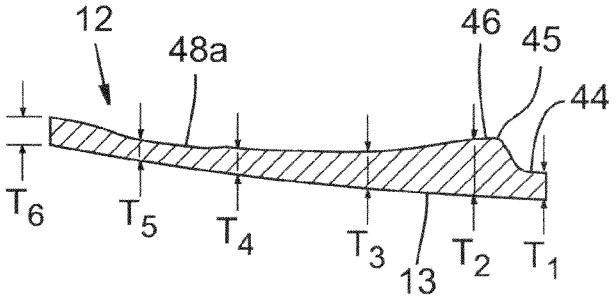

The face plate 12 of this and other embodiments has a reverse surface 40 shown in FIGS. 2(A)-2(C). Referring first to FIG. 2(A), the reverse surface 40 defines a point 42 situated in a central recess 44. The point 42 represents the approximate center of the "sweet spot" (optimal strike zone) of the face plate 12, not necessarily the center of the face plate, and is located in the approximate center of the recess 44. The central recess 44 is a "dimple" having a spherical or otherwise radiused sectional profile in this embodiment (see FIGS. 2(B) and 2(C)), and is surrounded by an annular ridge 46. At the point 42 the thickness of the face plate 12 is less than at the "top" 45 of the annular ridge 46 (See FIG. 2(B)). The top 45 is normally the thickest portion of the face plate 12. Outward from the top 45, the thickness of the face plate 12 gradually decreases. Hence, the central recess 44 and surrounding annular ridge 46 have a sectional profile (FIG. 2(C)) that is reminiscent of a "volcano." The volcano profile occupies at least most of the sweet spot of the face plate 12. Situated to the left and right of the central recess 44 and annular ridge 46 on the reverse surface 40 are "horizontally disposed," or lateral, recesses or dimples 48*a*, 48*b*, respectively. The recess 48*a* occupies a corresponding "toe zone," and the recess 48*b* occupies a corresponding "heel zone" of the reverse surface 40. In addition, "vertically disposed" recesses or dimples 48*c*, 48*d* are situated on the reverse surface 40 above and below, respectively, the annular ridge 46. The recess 48*c* occupies a corresponding "upper zone," and the recess 48*d* occupies a corresponding "lower zone" of the reverse surface. (It will be understood that the terms "horizontally disposed" and "vertically disposed" are not intended to denote absolute horizontally or verticality of arrangement, but rather simply to distinguish one set of recesses from the other based upon approximate relationships.) Since the face plate 12 in this embodiment is wider horizontally than vertically, the horizontally disposed recesses 48*a*, 48*b* are spaced farther apart (and farther from the annular ridge 46) than the vertically disposed recesses 48*c*, 48*d*. Also, the respective dispositions of the horizontally disposed recesses 48*a*, 48*b* reflect the greater width of the face above the x-axis $A_x$ than below this axis.

The horizontally disposed recesses 48*a*, 48*b* and vertically disposed recesses 48*c*, 48*d* are collectively termed "flanking"

recesses because they flank the central recess 44 and annular ridge 46. In this embodiment the horizontally disposed recesses 48*a*, 48*b* are substantially bilaterally symmetrical about the x-axis $A_x$, and the vertically disposed recesses 48*c*, 48*d* are substantially bilaterally symmetrical about the z-axis $A_z$. As exemplified in FIG. 2(B), the thickness of the face plate 12 in the flanking recesses 48*a*-48*d* is less than between the ridge 46 and the recesses 48*a*-48*d*. Hence, the central recess 44 and flanking recesses 48*a*-48*d* are respective regions in which the face plate 12 is thinned relative to other regions of the face plate, resulting in a face plate that does not have substantially uniform thickness.

In this embodiment, the thickness of the face plate 12 progressively decreases from the top 45 of the ridge 46 to the toe-zone recess 48*a*, and characteristically exhibits the same thickness profile with respect to the other flanking recesses 48*b*, 48*c*, 48*d*. In FIG. 2(B) note the thickness $T_1$ of the central recess 44, the thickness $T_2$ at the top 45 of the annular ridge 46, the thicknesses $T_3$ and $T_4$ progressively further from the annular ridge 46, the thickness $T_5$ of the toe-zone recess 48*a*, and the thickness $T_6$ of the peripheral zone of the face plate 12. By way of example, $T_1=T_4=T_6$, $T_5<T_1$, $T_3>T_4$, and $T_2>T_3$.

Figure 3:
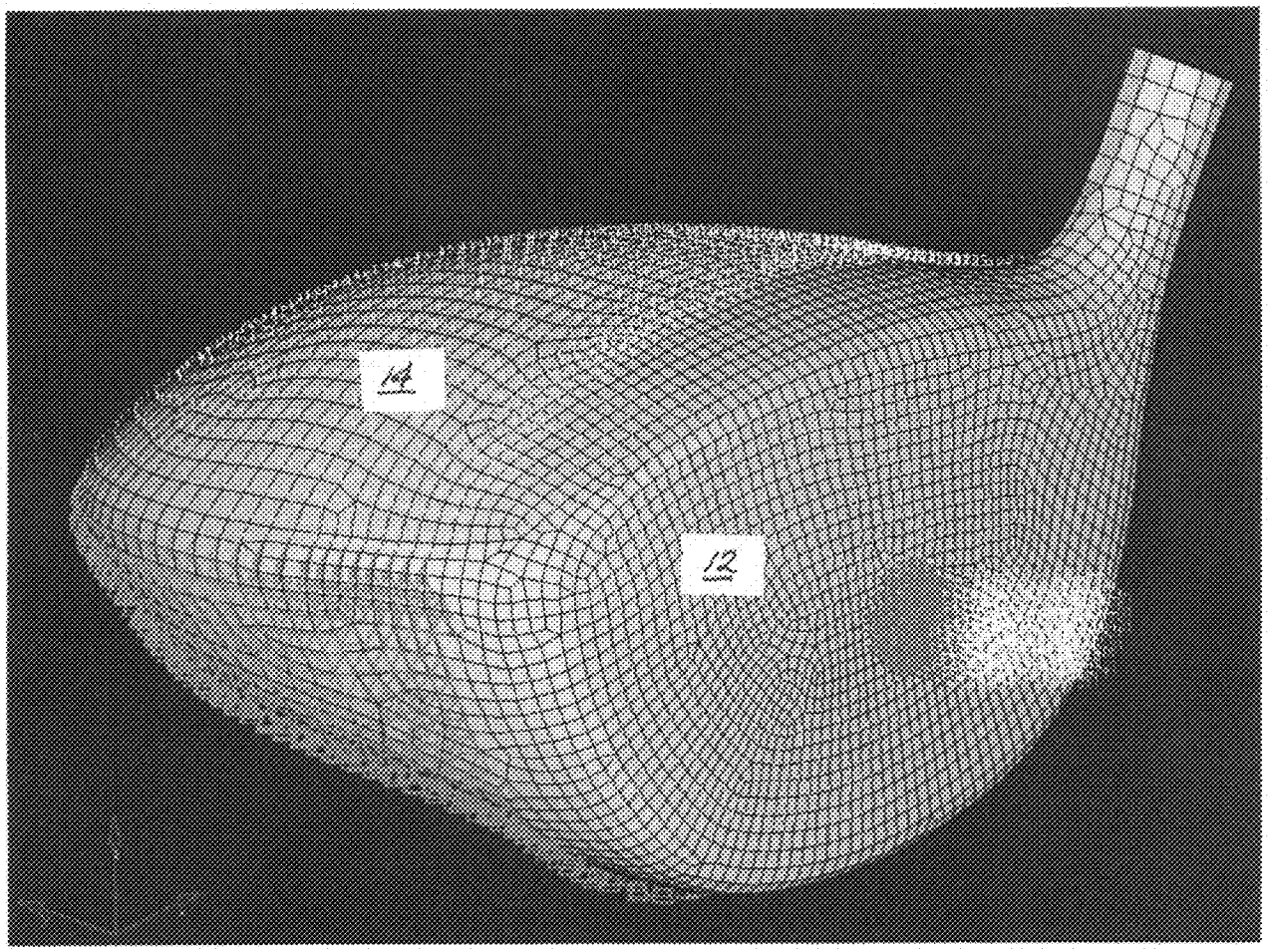
FIG. 3 is a perspective view of a wood-type club-head, depicting the manner in which pressure loading was applied in a circular region on the face plate as a representative ball-impact load. The pressure loading is indicated in color.

The configuration of this embodiment was determined as follows. The goals were to determine an optimal face-plate volume configuration (and hence mass of the face plate) in view of the stresses normally encountered by the face plate during use of the club and while the face plate is being subject to an arbitrary deflection constraint. Optimization began with a uniform-thickness face plate 12 and proceeded through a series of thickness evaluations in a "design space." The design space was defined as all elements that are parallel to the rear of the hosel 28 and located in a defined region extending toward the obverse surface 13 of the club-head 10. This space encompassed all elements located from the obverse surface 13 to 15-20 mm rearward of the external face. With respect to boundary conditions, all elements located outside the design space were fully constrained ($T_x$, $T_y$, $T_z$). As shown in FIG. 3, pressure loading in a circular central region on the face plate 12 was used as a representative ball-impact load, wherein the pressure vectors (red) were parallel to a target line (and thus to each other), not individually normal to the obverse surface 13.

Figure 4A:
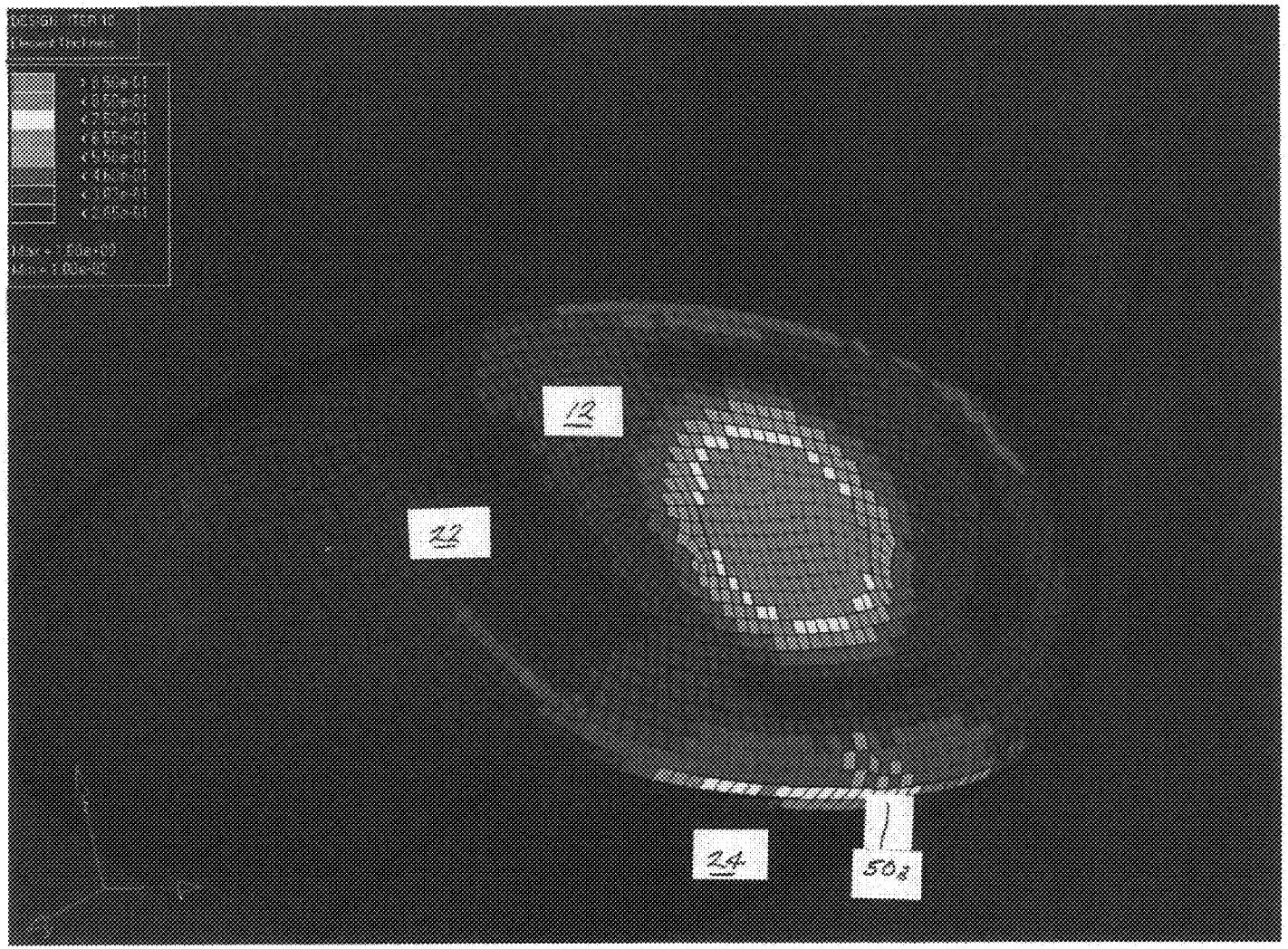
FIGS. 4(A)-4(C) depict exemplary results of an analysis directed at ascertaining regions in the face plate that could be made thinner, relative to other regions of the face plate, without compromising performance of the face plate striking a golf ball.
Figure 4B:
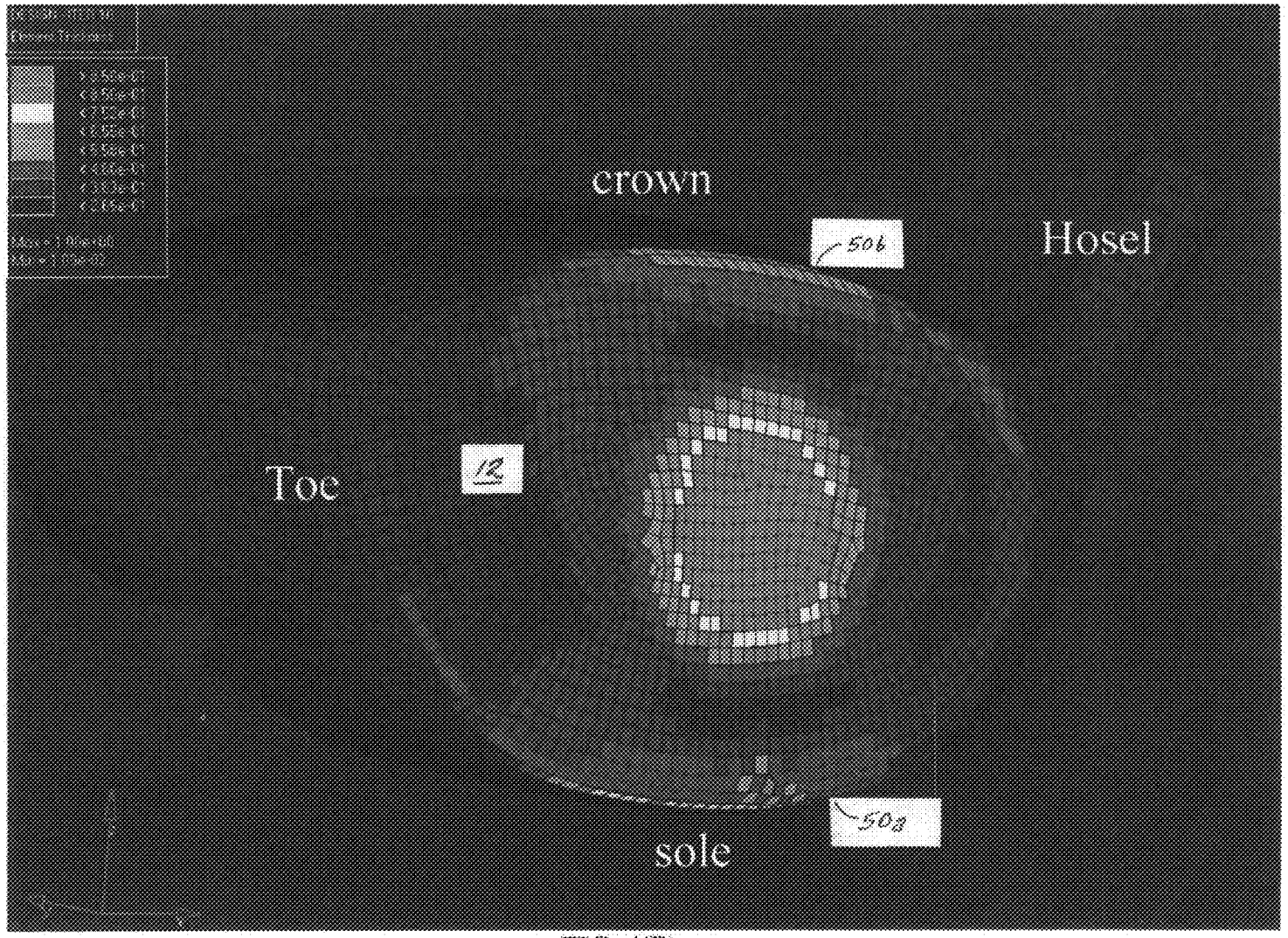
Figure 4C:
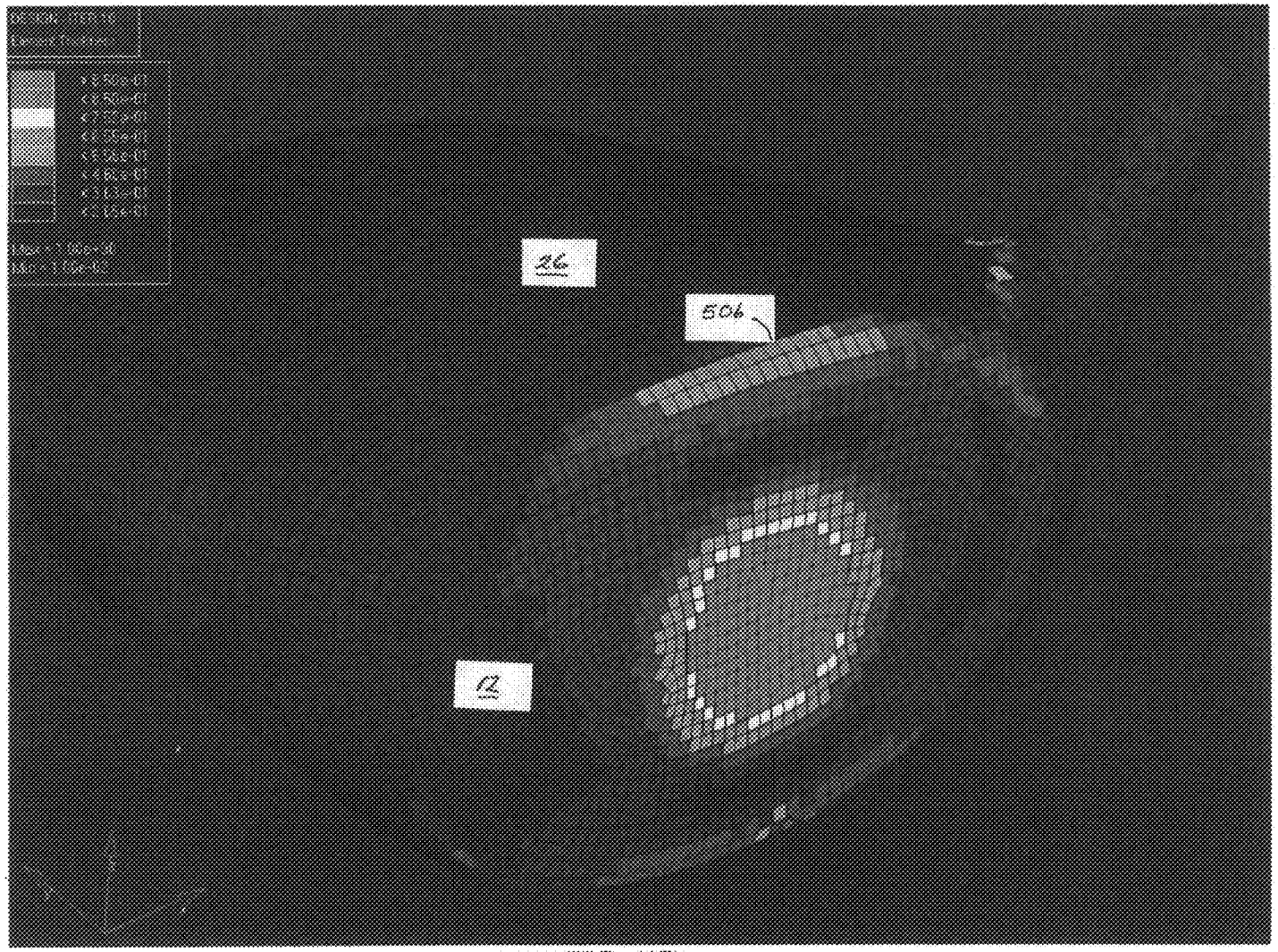

After many iterations the converged solution revealed regions in the face plate that could be made thinner, relative to other regions of the face plate, without compromising performance of the face plate striking a golf ball. Exemplary results are shown in FIGS. 4(A)-4(C). Specifically, FIG. 4(A) is a perspective view from slightly below a coronal (horizontal) plane that bisects the club-head. FIG. 4(A) shows the face 12 of the club-head, the toe 22, a front portion of the sole 24, and a sole lip 50*a* of the forward wall 15. FIG. 4(B) is a perspective view from a location on the coronal plane and shows the "Toe" (toe 22), the "Hosel" (hosel 28), the "crown" 26, the face plate 12, the front of the "sole" 24, the sole lip 50*a*, and a crown lip 50*b*. FIG. 4(C) is a perspective view from above the coronal plane and shows the crown 26, the face 12, and the crown lip 50*b* of the forward wall 15. The red, yellow, and other "light" regions reveal respective concentrations of stress in the center of the face 12, in the sole lip 50*a*, and in the crown lip 50*b*. The blue and black regions are respective regions in which material could be removed from the face plate 12 without significantly decreasing the stiffness of the face plate.

The flanking recesses 48*a*-48*d* in the embodiment shown in FIGS. 2(A)-2(B) are located in respective regions of the reverse surface 13 that correspond to respective dark regions shown in FIGS. 4(A)-4(C). In view of the general shapes of the dark regions, it will be understood that the profiles of the flanking recesses 48*a*-48*b* are not limited to the shapes and relative sizes shown in FIG. 2(A). For example, these parameters may change upon changing the size and/or shape of the strike plate 12. Other factors and parameters affecting the size and shape of these recesses are related to material properties such as strength (ultimate yield strength and tensile strength), crack-growth resistance (fatigue resistance), and ductility. It also will be understood that the respective spacings of the flanking recesses 48*a*-48*d* from each other and from the central recess 44, as shown in FIG. 2(A), is exemplary only and can deviate from the depicted configuration. Factors relevant to spacing of the recesses are related to material properties, such as strength (ultimate yield strength and tensile strength), crack (fatigue) resistance, and ductility. It will also be understood that the number of flanking recesses 48*a*-48*d* is not limited to what is shown in FIG. 2(A); a lesser or greater number can be used. Exemplary factors relevant to the number of recesses are COR distribution across the strike plate and the desired mass distribution with respect to COR and MOI.

Various techniques can be employed to form the face plate 12. A first exemplary technique is discussed in U.S. Pat. No. 6,904,663, incorporated herein by reference. This first exemplary technique is especially applicable to a metal face plate. Briefly, a face-plate "blank" is formed by rolling a sheet of the particular metal (e.g., titanium alloy) from which the face plate is to be made. The metal is rolled to an initial maximal thickness (equal to or greater than the thickness of the top 45 of the annular ridge 46) and has a prescribed peripheral profile. The surface of the blank that is destined to be the reverse surface 13 is machined to form the regions in which the thickness is less than the maximal thickness (i.e., regions other than the top 45 of the annular ridge 46). A CNC-milling machine or CNC-lathe, or other suitable machine tool, can be used to perform this machining. A second exemplary technique is discussed in U.S. Patent Publication No. 2004/0099538, incorporated herein by reference. This second exemplary technique generally involves the use of an electrode placed close to the surface of the face-plate blank in regions where material is to be removed. Area-specific removal is governed at least in part by use of a non-conductive template placed in connection with the surface to be "machined." A low-voltage, high-current is passed between the electrode and the face-plate blank in regions in which material is to be removed by electro-chemical oxidation. A third exemplary technique, applicable especially in instances in which the face plate is constructed of a composite material, is discussed in U.S. Patent Publication No. 2004/0235584, cited above and incorporated herein by reference. The composite plies are stacked and cured in the desired shapes and orientations. The desired thickness contours can be formed during the stacking and curing steps or afterward in a machining step.

Figure 5:
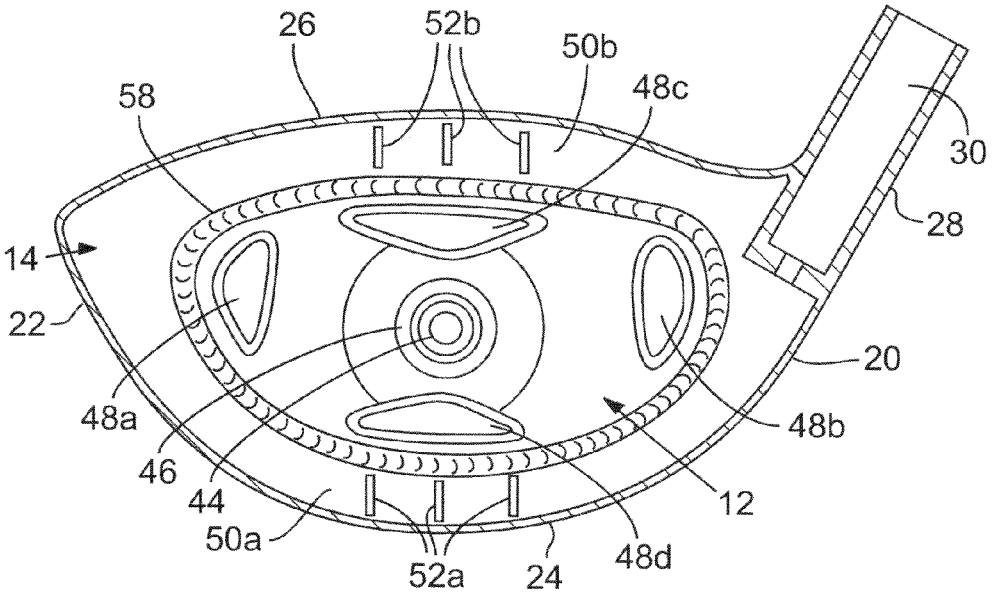
FIG. 5 is a section through a sagittal (vertical) plane of an example embodiment of a wood-type club-head, showing the interior ribs located interiorly of the sole lip and the interior ribs located interiorly of the crown lip. Also shown is the reverse surface of the face plate including dimples.

The stress concentrations in the center of the face plate 12 are accommodated by the thinner central recess 44 and thicker surrounding annular ridge 46. The stress concentrations in the sole lip 50*a* and crown lip 50*b* can be addressed, in another embodiment, by including one or more interior ribs behind (interiorly of) the sole lip 50*a* and one or more interior ribs behind (interiorly of) the crown lip 50*b*. An example embodiment is shown in FIG. 5, in which three "lower" interior ribs 52*a* are located interiorly of the sole lip 50*a* and three "upper" interior ribs 52*b* are located interiorly of the crown lip 50*b*. Also visible is the weld bead 58 by which the face plate 12 is mounted to the body 14. The ribs 52*a*, 52*b* in this embodiment have a gusset-like configuration in the depicted embodiment, and serve to stiffen the transition zone between the face plate 12 and body 14 behind the sole lip 50*a* and between the face plate and body behind the crown lip 50*b*.

Other rib configurations than shown in FIG. 5 can be used as deemed advantageous or necessary. In one group of embodiments, the respective numbers of ribs 52*a*-52*b* are different than the three each that are depicted. For example, one embodiment has one upper rib 52*b* and three lower ribs 52*a*, and another embodiment has two upper ribs 52*b* and three lower ribs 52*a*. Thus, the number of upper ribs 52*b* and lower ribs 52*a* need not be the same and are not limited to three. In another group of embodiments, ribs are provided that have other than the vertical dispositions shown in FIG. 5, which may be advantageous from an ease-of-manufacturing perspective (e.g., ease of investment casting). For example, ribs can be located interiorly of the heel lip and/or toe lip, and these ribs can be in addition to or alternatively to the upper ribs 52*b* and lower ribs 52*a*. In one example, one or two ribs are situated interiorly of the toe lip and on or two ribs are situated interiorly of the heel lip.

An advantage of the ribs 52*a*, 52*b* shown in FIG. 5 is that they allow the thickness of at least the sole lip 50*a* and crown lip 50*b* to be reduced, thereby reducing mass in these locations for relocation elsewhere in the club-head as discretionary mass. The same benefit is realized from ribs in other locations as discussed above. Ribs can reduce the CT of the face plate by approximately 25 μsec, which corresponds to a reduction of approximately 0.5 mm in peak face thickness. By configuring the ribs 52*a*, 52*b* in this example embodiment as thin structures as shown, the amount of discretionary mass removed from the corresponding lip regions can be (and desirably is) less than the mass of the ribs.

The ribs 52*a*-52*b* also can prevent the club-head of these embodiments from exhibiting a COR exceeding the USGA limit (COR≤0.830, CT≤257 μsec). This is believed to be due to the ribs acting to stiffen the perimeter of the face plate region, resulting in a more "fixed" boundary condition. As an alternative to including the ribs 52*a*-52*b*, the sole lip 50*a* and crown lip 50*b* can be thickened (e.g., by 0.3-0.4 mm) relative to other transition regions between the face plate and body 14.

As yet another alternative to the ribs 52*a*, 52*b*, respective composite inserts can be bonded in substantially the same locations as the ribs, namely inwardly of the crown lip and inwardly of the sole lip.

The club-head configurations discussed above allow additional club-head mass to be removed from the strike plate 12 for use as discretionary mass elsewhere in the club-head. In other words, the stiffness-to-mass ratio of the strike face is improved without compromising the performance of the golf club and without exceeding applicable USGA limits.

Figure 6:
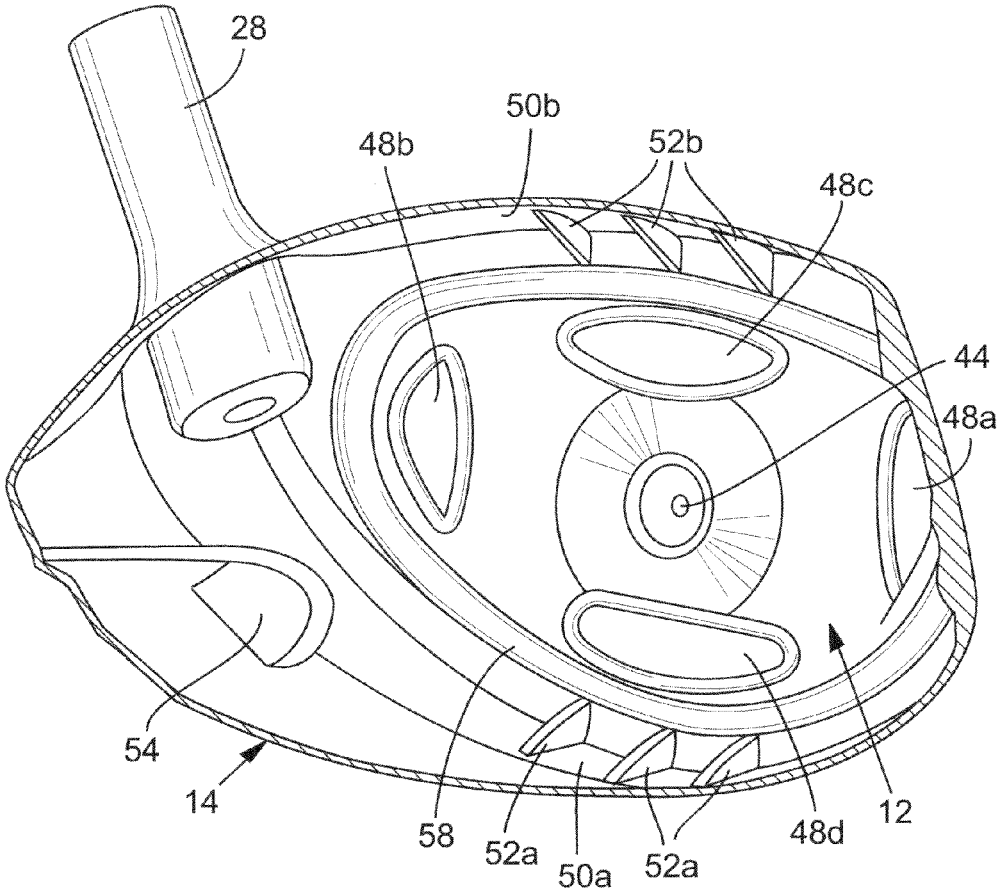
FIG. 6 is a perspective view of another embodiment of a club-head, showing the body, face plate, central dimple, annular ridge, flanking dimples, internal ribs, and a weight plug.

Yet another view of an embodiment of a club-head is shown in FIG. 6, which depicts the face plate 12, the body 14, the central recess 44, the annular ridge 46, the flanking recesses 48*a*-48*d*, the sole lip 50*a* with ribs 52*a*, the crown lip 50*b* with its ribs 52*b*, the hosel 28, and a weight plug 54 mounted, as a unit of discretionary mass, in the body 14. Also visible is the weld bead 58 around the circumference of the face plate 12.

In a specific example, the face plate 12 and body 14 are fabricated of Ti-6Al-4V titanium alloy. The walls of the body 14 have a thickness ranging from 0.8 to 1.0 mm. Referring further to FIGS. 2(A)-2(B), the central recess 44 has a minimal thickness $T_1$ of 2.3 mm. The peripheral-edge region of the face plate also has a thickness $T_6$ of 2.3 mm. The top 45 of the annular ridge 46 has a thickness $T_2$ of 4.8 mm, and the annular ridge 46 slopes (radially outward) to a thickness $T_3$ of 3 mm. The thickness of the face plate 12 progressively decreases to a thickness $T_4$ of 2.3 mm just adjacent the toe-zone recess 48*a*. The thickness $T_5$ at the "bottom" of the toe-zone recess 48*a* is 1.8 mm. The other flanking recesses 48*b*-48*d* have the same thickness. Thus, in this example, the flanking recesses 48*a*-48*d* are the thinnest regions of the entire face plate 12. These thickness dimensions are established with consideration given to durability constraints of the club-head (stress level and thickness would be a function of size and shape of features).

The principles described above can apply to face plates made of material(s) other than titanium alloy, such as steel or other isotropic material, including composites.

Figure 7A:
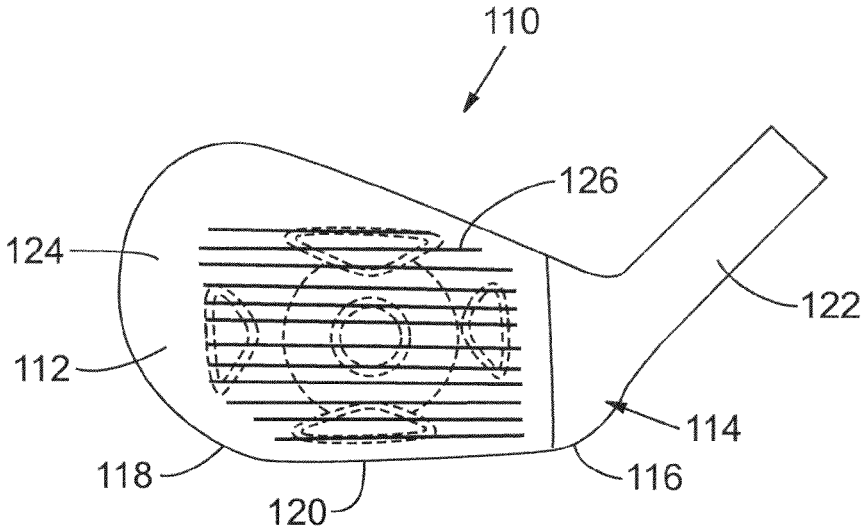
FIGS. 7(A)-7(D) are respective views of an embodiment of an iron-type club-head comprising a face plate with dimpled reverse surface.
Figure 7C:
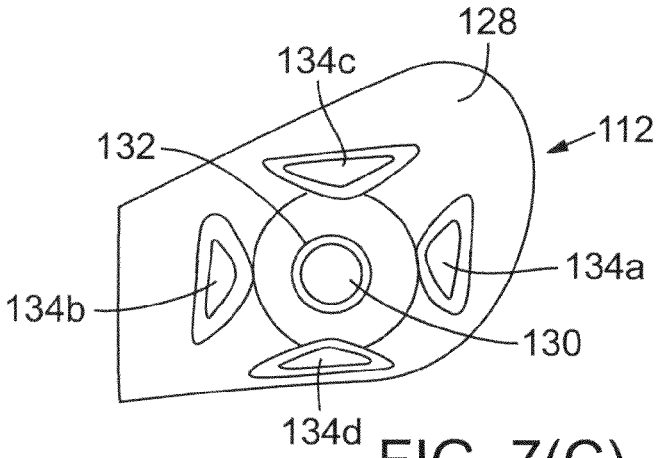
Figure 7B:
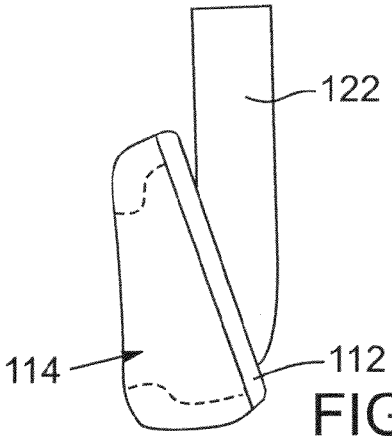
Figure 7D:
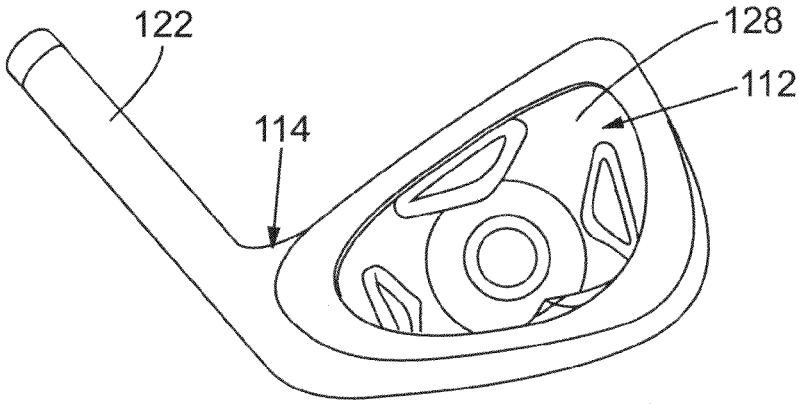

An embodiment in which a face plate similar to those described above, but utilized in an iron-type club-head 110, is shown in FIGS. 7(A)-7(D). FIG. 7(A) depicts a frontal view of the club-head 110, showing the face plate 112, the body 114, the heel 116, the toe 118, the sole 120, and the hosel 122. The face plate 112 has an obverse surface 124 that, characteristic of iron-type club-heads, has score lines 126. But, in contrast to a face plate on a metal wood, the face plate 112 is substantially planar rather having bulge and roll. Turning now to FIG. 7(B), a toe-end view is provided showing the face plate 112 relative to the body 114 and hosel 122. The reverse surface 128 is depicted in FIG. 7(C), depicting the central recess 130, the annular ridge 132, and the flanking recesses 134*a*-134*d*. A reverse view of the club-head is shown in FIG. 7(D), showing the body 114, the reverse surface 128 of the face plate 112, and the hosel 122. Note that, in this embodiment, the body 114 is open in the rear.

Whereas the foregoing description is in the context of representative embodiments, the invention is not limited to those embodiments. On the contrary, the invention is intended to encompass all modifications, alternatives, and equivalents as may be included in the spirit and scope of the invention, as defined by the appended claims.

What is claimed is:

1. A club-head for a golf club, the club-head comprising:

a body having a top, a sole, a toe, a heel, and a front;

a face plate attached to the front of the body, the face plate having a striking surface, a reverse surface, a peripheral zone, a toe zone, a heel zone, an upper zone, a lower zone, and a central zone, the reverse surface defining in the central zone a central recess having a thickness and a substantially annular ridge surrounding the central recess and having a maximum respective thickness, and the peripheral zone having a respective thickness, wherein the maximal thickness of the annular ridge is greater than the respective thicknesses of the central recess, the body further comprises a sole lip, a crown lip, a toe lip, and a heel lip, the face plate being attached by a bond to the front of the body at the lips; and at least one of the lips further comprises at least one rib that does not touch any portion of the face plate that is attached to the front of the body, and wherein the bond is located between the at least one rib and the face plate.

2. The club-head of claim 1, wherein the thickness of the peripheral zone is substantially equal to the thickness of the central recess.

3. The club-head of claim 1, configured as a metal-wood club-head.

4. The club-head of claim 1, configured as an iron-type club-head.

5. The club-head of claim 1, wherein the reverse surface is machined to form the central recess being less than the maximal thickness.

6. The club-head of claim 1, wherein the face plate comprises composite plies that are stacked and cured and form a variable thickness contour.

7. The club-head of claim 1, wherein the at least one rib includes at least two lower interior ribs located interiorly of the sole lip.

8. The club-head of claim 1, wherein the at least one rib includes at least two upper interior ribs located interiorly of the crown lip.

9. The club-head of claim 1, wherein the at least one rib includes a gusset-like configuration to stiffen a transition zone between the face plate and the body behind the crown lip.

10. The club-head of claim 1, wherein the at least one rib is vertically disposed.

11. The club-head of claim 1, wherein the at least one rib includes a gusset-like configuration to stiffen a transition zone between the face plate and the body behind the sole lip.

12. The club-head of claim 1, wherein an amount of mass removed from a corresponding lip region is less than a mass of the at least one rib to allow discretionary mass to be relocated elsewhere in the club-head.

13. The club-head of claim 1, wherein the at least one rib is located interiorly of the toe lip.

14. The club-head of claim 1, wherein the at least one rib is located interiorly of the heel lip.

15. The club-head of claim 1, wherein the at least one rib reduces the characteristic time by about 25 μsec.

16. The club-head of claim 1, wherein the at least one rib is configured to reduce a peak face thickness by about 0.5 mm.

17. The club-head of claim 1, wherein the at least one rib includes at least three ribs.

18. A club-head for a golf club, the club-head comprising:

a body having a top, a sole, a toe, a heel, and a front;

a face plate attached to the front of the body, the face plate having a striking surface, a reverse surface, a peripheral zone, a toe zone, a heel zone, an upper zone, a lower zone, and a central zone, the reverse surface defining in the central zone a central recess having a thickness and a substantially annular ridge surrounding the central recess and having a maximum respective thickness, and the peripheral zone having a respective thickness, wherein the maximal thickness of the annular ridge is greater than the respective thicknesses of the central recess and peripheral zone, the body further comprises a sole lip, a crown lip, a toe lip, and a heel lip, the face plate being attached by a bond to the front of the body at the lips; and at least one of the lips further comprises at least one rib that does not touch any portion of the face plate that is attached to the front of the body, and wherein the bond is located between the at least one rib and the face plate.

19. A club-head for a golf club, the club-head comprising:

a body having a top, a sole, a toe, a heel, and a front;

a face plate attached to the front of the body, the face plate having a striking surface, a reverse surface, a peripheral zone, a toe zone, a heel zone, an upper zone, a lower zone, and a central zone, the reverse surface defining in the central zone a central recess having a thickness and a substantially annular ridge surrounding the central recess and having a maximum respective thickness, and the peripheral zone having a respective thickness, wherein the maximal thickness of the annular ridge is greater than the respective thicknesses of the central recess and peripheral zone, the body further comprises a sole lip, a crown lip, a toe lip, and a heel lip, the sole lip and crown lip being thicker than respective wall thicknesses of the toe, heel, sole, and top of the body, the face plate includes a sweet spot and the central recess and annular ridge are is located substantially within the sweet spot, the face plate being attached by a bond to the front of the body at the lips; and at least one of the lips further comprises at least one rib that does not touch any portion of the face plate that is attached to the front of the body, and wherein the bond is located between the at least one rib and the face plate.

20. The club-head of claim 19, wherein the at least one rib includes a gusset-like configuration to stiffen a transition zone between the face plate and the body behind the crown lip.

* * * * *